US009877539B1

(12) United States Patent
Jackrel

(10) Patent No.: US 9,877,539 B1
(45) Date of Patent: Jan. 30, 2018

(54) METHOD OF MANUFACTURING FOOTWEAR

(71) Applicant: Donald Jackrel, Lake Worth, FL (US)

(72) Inventor: Donald Jackrel, Lake Worth, FL (US)

( * ) Notice: Subject to any disclaimer, the term of this patent is extended or adjusted under 35 U.S.C. 154(b) by 105 days.

(21) Appl. No.: 15/014,141

(22) Filed: Feb. 3, 2016

Related U.S. Application Data

(60) Provisional application No. 62/111,426, filed on Feb. 3, 2015.

(51) Int. Cl.
*A43B 7/12* (2006.01)
*A43B 23/07* (2006.01)

(52) U.S. Cl.
CPC ..... *A43B 7/125* (2013.01); *A43B 23/07* (2013.01)

(58) Field of Classification Search
CPC ..... A43B 19/00; A43B 23/07; A43B 7/125
See application file for complete search history.

(56) References Cited

U.S. PATENT DOCUMENTS 5,426,869 A * 6/1995 Gore ..... A43B 7/125 12/142 T
5,664,343 A * 9/1997 Byrne ..... A43B 7/125 36/12
5,802,740 A * 9/1998 Merk, Sr. ..... A43B 7/125 36/10
2004/0216332 A1* 11/2004 Wilson ..... A43B 7/08 36/55
2013/0232818 A1* 9/2013 Wiener ..... A43B 7/125 36/84

FOREIGN PATENT DOCUMENTS

EP 1195100 A1 * 4/2002 ..... A43B 7/12
WO 2013134446 A1 9/2013

* cited by examiner

*Primary Examiner* — Ted Kavanaugh
(74) *Attorney, Agent, or Firm* — Tolpin & Partners, PC; Thomas W. Tolpin

(57) ABSTRACT

An improved method of manufacturing footwear includes lasting a lining and an upper material over a last board, such that the lining extends further over the last board and the upper material. Stitching and/or adhesive may be used to attach the lining and the upper material to one another. A gasket substantially covering the last board, the outside is then utilized. The gasket may include a web substrate and a thermoplastic adhesive. The lining may include one or two membranes that may be laminated between a tricot abrasion layer and a face fabric and/or insulation if required.

7 Claims, 6 Drawing Sheets

METHOD OF MANUFACTURING FOOTWEAR

CROSS-REFERENCE TO RELATED APPLICATIONS

This application claims priority to U.S. Provisional Application Ser. No. 62/111,426 filed on Feb. 3, 2015, the contents of which are hereby incorporated in their entirety.

STATEMENT REGARDING FEDERALLY SPONSORED RESEARCH OR DEVELOPMENT

Not Applicable.

NAMES OF PARTIES TO A JOINT RESEARCH AGREEMENT

Not Applicable

REFERENCE TO SEQUENCE LISTING, A TABLE, OR A COMPUTER PROGRAM LISTING APPENDIX SUBMITTED ON A COMPACT DISC AND INCORPORATION-BY-REFERENCE OF THE MATERIAL

Not Applicable.

COPYRIGHT NOTICE

Not Applicable

BACKGROUND OF THE INVENTION

Field of Endeavor

The present invention relates to systems and methods for manufacturing footwear. More particularly, the invention relates to an improved method for manufacturing footwear that is consistently waterproof, breathable and comfortable.

Background Information

Sandals, shoes, boots and other footwear are some of the first devices ever created by man. They remain essential items, especially in certain industries such as the military, mining, farming, services, occupational, restaurants and a plethora of other industries. It is often desirable to have footwear such as boots that are watertight and sufficiently protect against the elements, while also minimizing damage caused to feet by excessive sweating in footwear that insufficiently breathes. It is also desirable for footwear to be sturdy but also lightweight and comfortable.

The most common material currently used in footwear lining to provide the above-described properties is polytetrafluoroethylene, or PTFE and expanded polytetrafluoroethylene, or ePTFE. Other materials have also been used and despite a large market for footwear having desirable properties, many difficulties remain. One common method for preparing heavy-duty footwear is shown in FIG. 1.

FIG. 1 illustrates a prior art method currently in use to form an item of footwear, such as a boot. The lower portion of the footwear 10 may include a lining 12 and an upper 14. The lining 12 may be comprised of a face fabric 16, a membrane 18 and a tricot abrasion layer 20. Adhesives are placed in regions 22 and 24 between the face fabric 16 and membrane 18, and between the membrane 18 and tricot abrasion layer 20, respectively. All 3 layers of the lining 12 have been laminated together, the lining 12 may undercut the upper 14 and stretched over a last board 26. The upper is then utilized. The waterproof quality of the footwear is questionable. A booty insert may then be formed by cutting and tape sealing it into a two dimensional configuration substantially the same as the boot itself. The top of the inserts is then stitched to the top of the upper 14 and slipped inside the boots and affixed to the lining using adhesive or no adhesive. This process tends to form wrinkles and creases in the insert in the interior of the boot. As a results, the boot is less comfortable and may case blisters and water seepage.

The lining 12 and the upper material 14 may be affixed to each other in the region stretched over the last board 26 by means of stitching 28. Optionally, adhesive may be used in place of or in addition to the stitching 28. The lower end 32 of the upper material 14 may extend further over the last board banned the lower end of the lining 12. During the last step of manufacturing the footwear, the bottom or sole 30 may be attached to the last board 26 and the upper material 14 using, adhesives. The manufacturing method shown in FIG. 1 does not provide an item that is airtight and watertight until after the sole is attached. Because only the completed product is watertight and/or airtight, it is susceptible to losing its watertight and airtight properties upon damage to any single component. Furthermore, during wear and tear, it is not uncommon for various components of the footwear to become at least partially detached. Even minor flaws or breaks in seals may result in the entire item losing its watertight properties.

In view of the foregoing, there is a need to provide an efficient and reliable way to produce rugged, sturdy footwear. It is also desirable to provide an improved method of manufacturing footwear that is waterproof and breathable. It is also desirable to provide an improved method of efficiently manufacturing footwear and that remains comfortable throughout its life.

BRIEF SUMMARY OF THE INVENTION

Accordingly, the primary object of the present invention is to provide a method of manufacturing footwear, and footwear, in accordance with the principles of the invention that may be watertight, but also breathable and comfortable. In addition, the method of manufacturing footwear, and footwear, in accordance with the principles of the invention may retain these properties even after extensive use.

In greater detail, a boot, shoe or other footwear item may be formed in accordance with the principles of the invention by laminating a tricot layer, a membrane layer, an optional layer of insulation and a face fabric to form a lining. The lining is then placed flush with an upper material and stretched over a last board. The lining may extend further over the last board than the upper material. Either stitching or an adhesive may be used to affix the portions of the upper and the lining that extend over the last board to each other. A gasket including a web having a thermoplastic material may be flash heated and applied under pressure to the last board, lining and upper. The resulting footwear is airtight and watertight, and breathable. At this point. Application of cement and a sole may further strengthen the footwear.

In one embodiment, the membrane is a monolithic membrane capable of absorbing sweat or other liquids and may optionally include insulation.

In another embodiment, the lining includes two membranes, a monolithic membrane and a porous membrane that is laminated or extruded onto each other.

In a further embodiment, both adhesives, and stitching may be used to attach the lining and the upper to one another.

By utilizing this construction, the manufacturer will achieve substantial cost savings in both the manufacturing method and maximize savings while creating a substantially improved footwear product with virtually no wrinkles, improved breathability and totally waterproof qualities. The key features of the improved process include manufacturing footwear with substantial manufacturing cost savings and with significantly improved comfort for the wearer to enjoy.

It is therefore an object of the present invention to provide an improved footwear item having superior waterproof but breathable properties with substantially reduced wrinkles for added comfort and which retains those properties even after extensive wear.

These and other objects and advantages of the present invention will become apparent from a reading of the attached specification and appended claims. There has thus been outlined, rather broadly, the more important features of the invention in order that the detailed description thereof that follows may be better understood, and in order that the present contribution to the art may be better appreciated. There are features of the invention that will be described hereinafter and which will form the subject matter of the claims appended hereto.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION

Figure 1:
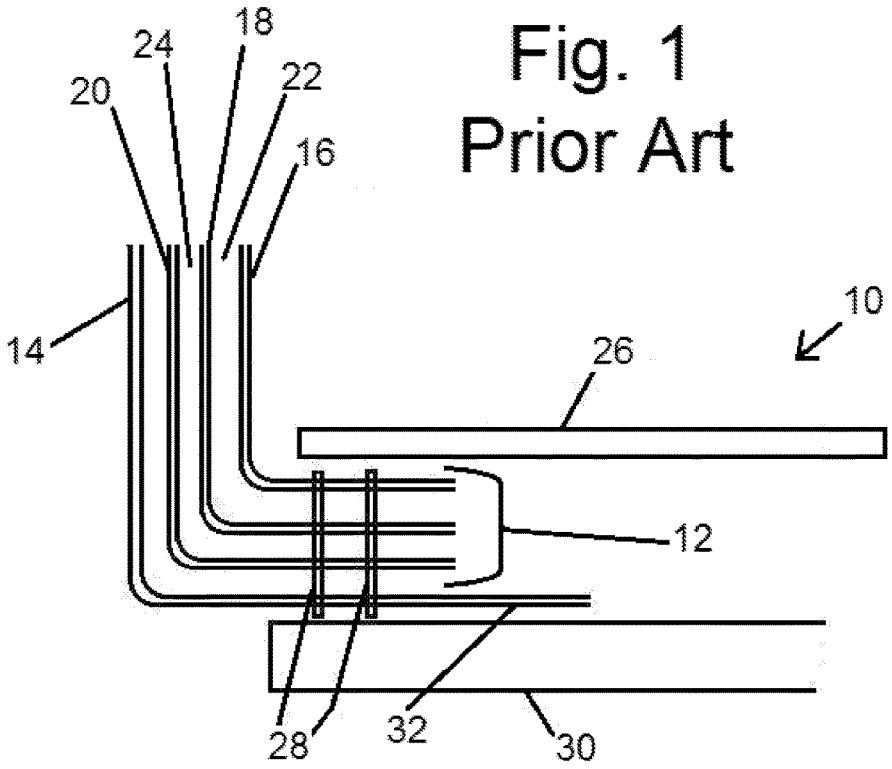
Fig. 1 Prior Art
FIG. 1 is a side cross-sectional view of a prior art method of manufacturing footwear.

Before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

Disclosed is an improved method for manufacturing footwear, such as a shoe or a boot. Those skilled in the art will appreciate that the improved method for manufacturing footwear disclosed herein may also optionally be used for manufacturing other garments, including overshoes, waders and the like. For clarity, the following terms generally have the following definitions:

An "upper" is often composed of leather or canvas or combinations of the two and is the portion of the footwear seen above the sole when a shoe is worn. The upper itself may be formed from one or more layers.

A "lining" refers to the material on the interior of a footwear item. It may be comprised of one or more layers of material that may be adhered to one another using glue, cement, adhesive or other commonly used materials for adhering various fabrics flush against one another. The lining may have an abrasion-resistant layer, a membrane, insulation and/or an inner lining.

An "insole" is the material on the floor of the inside of the shoe with which the foot is in contact when the shoe is being worn.

An "outsole" is the material on the bottom and exterior of the sole and is what comes in contact with the ground while walking.

A "welt" is a strip of leather or other material which runs along the top of the perimeter of the outsole. Its primary function is for attaching the upper to the outsole.

A "last board" is a planar board having the general shape of an outline of a foot. The last board is what generally gives a shoe its shape. In the art of footwear construction, a "last" may refer to a three-dimensional object in the general shape of a shoe about which an item of footwear is formed. A "last board" as used herein refers to a piece of material that defines the general shape of the base of the shoe and becomes an integral component thereof during the construction process. The last board may generally have the shape of the bottom of a foot and may be planar or contoured.

The terms "footwear," "shoe," and "boot" are used interchangeably and all refer to devices worn over a person's foot.

Figure 2:
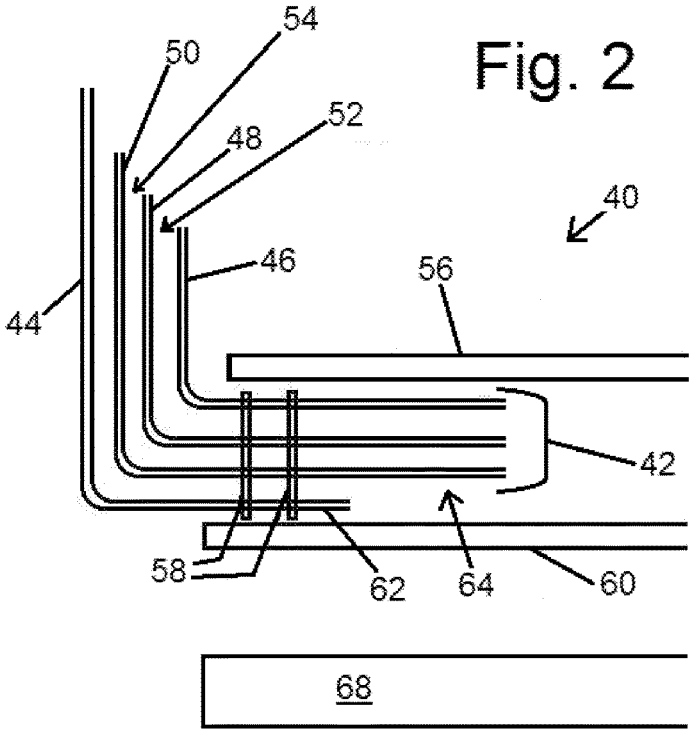
FIG. 2 is a side cross-sectional view of a method of manufacturing footwear in accordance with the principles of the invention.

FIG. 2 shows a method of manufacturing footwear in accordance with the principles of the invention. The lower region of a footwear product 40 may include a lining 42 and an upper material 44. The upper material 44 may be made from leather, textiles, or other materials commonly used on the exterior of footwear. Similar to the footwear shown and described in FIG. 1, the lining 42 may be comprised of a face fabric 46, a membrane 48 and an abrasion-resistant layer 50. An adhesive 52 may be placed between the face fabric 46 and the membrane 48. Similarly, an adhesive may be placed between the membrane 48 and the abrasion-resistant layer 50. The 3 layers may then be laminated together to form a unitary lining 42.

The lining 42 may be placed flush against the upper material 44. The upper material 44 and the lining 42 may be stitched or otherwise affixed together near the top of an article of footwear, not shown. The lining 42 and the upper material 44 may then be pulled over a last board 56 and attached to each other by stitching 58, or by adhesive. The stitching 58 may preferably provide relatively large openings in the upper material 44 and the difference layers of the lining 42. Wider stitching holes may assist in the permeation of all layers by the thermoplastic adhesive of the gasket 60, explained in more detail below. The lower end 64 of the lining 42 may extend further over the last board 56 than the lowered and 62 of the upper material 42.

A manufacturing method in accordance with the principles of the invention may also include application of a gasket 60 over both the upper material 44 and the lower portion 64 of the lining 42. The gasket 60 may be comprised of a thermoplastic adhesive that may be supported by a mesh or web. The gasket 60 may be flash heated in order to melt the thermoplastic adhesive. Substantial pressure may then be applied to the gasket in order to form an airtight and watertight seal from the outer material 44 to the last board 56. As a result, a footwear products manufactured in accordance with the principles of the invention may form an airtight and/or watertight seal. Before the sole or bottom of the footwear is attached. In the last stage of manufacturing a footwear product, the bottom or sole 68 may be affixed to the gasket 60 covering the last board 56.

Figure 3:
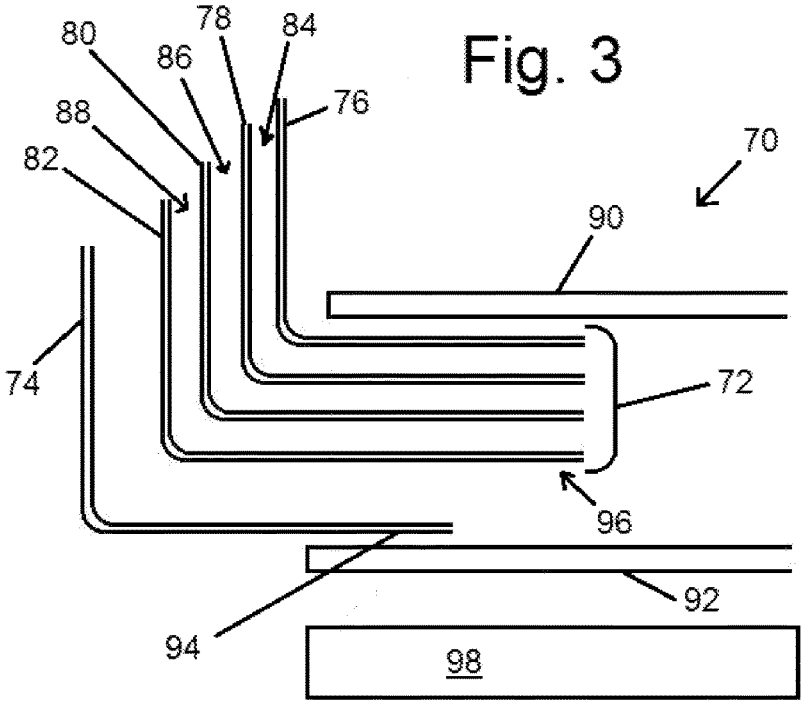
FIG. 3 is a side cross-sectional view of a method of manufacturing footwear in accordance with the principles of the invention.

FIG. 3 shows an alternative embodiment of a lower region 70 of a footwear products manufactured in accordance with the principles of the invention. A lining 72 may be comprised of a face fabric 76, a monolithic membrane 78, a microporous membrane 80, and an abrasion-resistant layer 82. In this embodiment, a monolithic membrane 78 is in contact with the face fabric 76 and is held against it by adhesive 84, while the microporous membrane 80 is attached to the tricot abrasion layer 82 by an adhesive 88. The microporous membrane 80 and the monolithic membrane 78 may then be held together by an adhesive 86. Optionally, the monolithic membrane 78 and the microporous membrane 80 may be switched such that the monolithic membrane 78 lies next to the tricot abrasion layer 82 and the microporous membrane 82 lies next to the face fabric 76. The monolithic membrane may be capable of absorbing sweat, which may then be dissipated.

The lining 72 may be affixed to the upper material 74 about the topic region of the footwear. The lining 72 and the upper material 74 may be pulled over a last board 90 such that the lower end 96 of the lining 72 extends further over the last board 90 than the lower end 94 of the upper material 74. In this embodiment, stitching may not be used to hold together the lower end 94 of the upper material 74 and the lower end 96 of the lining 72. Instead, an adhesive may be used. A thin layer of primer is coated onto and over the lasted upper and lining laminate, then flash heat activated. Then the gasket is flash heat activated then joined together with a vacuum forming in a conventional sole press machine.

Once the lower ends 94 and 96 of the upper material 74 and lining 72, respectively, are pulled over the last board 90 a gasket 92 may be applied to the last board 90, the lining 72 and the upper material 74. As with the gasket of FIG. 1, the gasket 92 may include a thermoplastic adhesive that is flash heated and then pressed under high pressure utilizing a conventional sole press or by utilizing a vacuum forming machine onto the lower portion of the footwear 70. Subsequently, a sole or bottom 98 may be attached.

Figure 4:
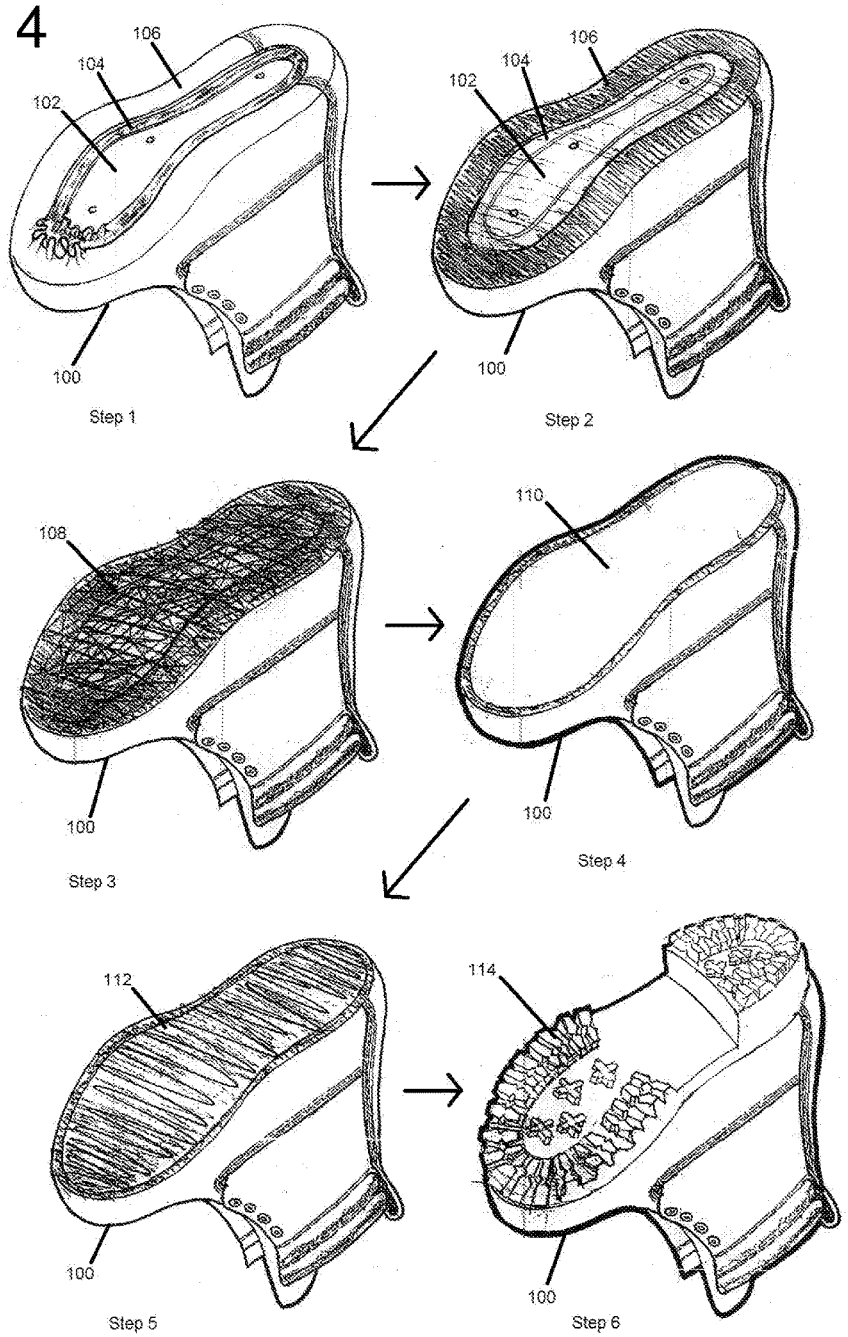
FIG. 4 is a perspective, step-wise view of a method of manufacturing footwear in accordance with the principles of the invention

FIG. 4 shows a process by which the bottom portion of an article of footwear may be fabricated. A boot 100 may include an upper material 106 and a lining 104. In Step 1, the upper material 106 and the lining 104 are stretched over a last board 102. The lining 104 extends further over the last board and the upper material 106.

In step 2. The exposed region of the upper material 106 that extends over the last board 102 may be treated such that it has a rough surface. In step 3, cement 108 may be liberally deposited over the entire bottom of the boot 100. A gasket 110 may then be applied to the cement 108 covered bottom in step 4. The gasket 110 provides an effective seal, making the boot watertight. In step 5, a glue 112 is applied so that the sole 114 may be attached to the bottom of the boot 100 in step 6. Or in the case of direct attached outsoles, the adhesive is not required.

Figure 5:
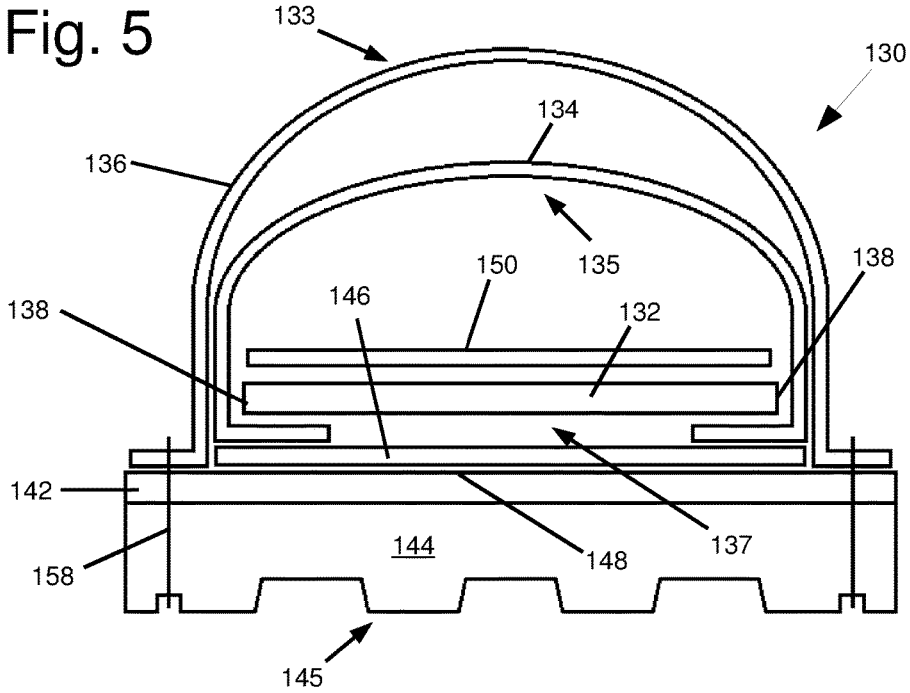
FIG. 5 is a front cross-sectional view of a footwear item manufactured in accordance with the principles of the invention.
Figure 6:
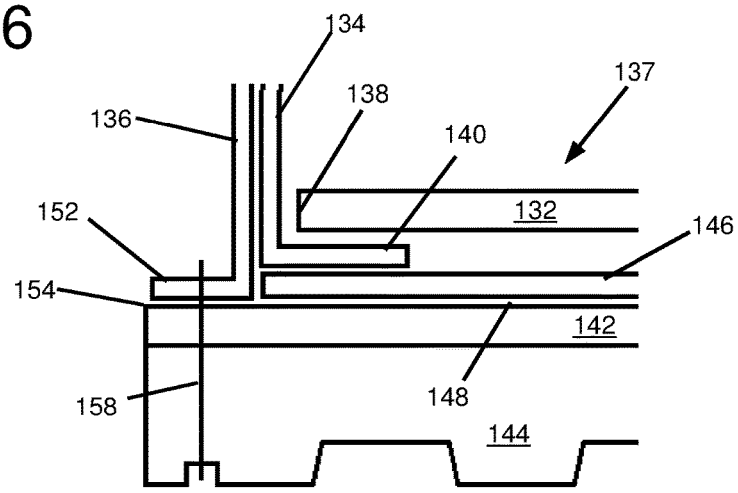
FIG. 6 is a front cross-sectional view of a portion of a footwear item manufactured in accordance with the principles of the invention.

FIG. 5 shows an alternative embodiment of a footwear item constructed in accordance with the principles of the invention. FIG. 5 shows a cross-section of one side of the boot 130, but illustrates the fashion in which the components of the boot are joined together. FIG. 6 is an enlarged view of one side of the boot 130 shown in FIG. 5. In this embodiment, the footwear item is a boot 130. The boot 130 is constructed around a last board 132 which is substantially planar and has the desired shape of the bottom of the boot. It includes a midsole 142 and an out sole 144 which has treading 145 on its bottom. One of the final steps in the construction of the boot 130 is the insertion of an insole 150. The lining 134 may be similar to the linings shown in FIGS. 2 and 3, and may be comprised of more than one layer that may include an insulating layer or a waterproof breathable layer.

The last board 132 acts as a substrate about which the rest of the boot is formed. The last board 132 includes an outer edge 138 along its periphery over which the lining 134 and upper 136 may be pulled. During manufacture, the components are typically upside down and would be inverted as compared to their orientation shown in FIGS. 5 and 6. The boot 130 also includes a midsole 142 affixed to the outsole 144. A gasket 146 bindings the lining 134 and the last board 132 to the top 148 of the midsole 142.

A lining 134 and an upper 136 are both formed in the shape desired for the boot 130 except for the bottom of the boot. They are positioned flush against each other such that neither material includes wrinkles. The lining 134 and upper 136 may optionally be bound together using glue or an adhesive. Optionally, only a portion of the lining 134 and upper 136 may be bound together. The upper 136 has a medial region 133 extending across the top of the boot 130. Similarly, the lining 134 has a medial region 135 extending across the top of the boot 130. FIG. 5 shows the medial regions 133 and 135 of the upper 136 and lining 134, respectively, being spaced apart from one another. This has been done in FIG. 5 for clarity. The lining 134 and upper 136 are usually flush against one another at most or all locations. The lining 134 and upper 136 are pulled down over the edge 138 of the last board 132. In this embodiment, the distal end 140 of the lining is pulled over and covers the edge 138 of the last board 132. A gasket 146, which consists of a layer of cement, binds the last board 132 and the distal end 140 of the lining 134 to the midsole 142. This sandwiches the distal end 140 of the lining 134 between the last board 132 and the midsole 142. As a result, a watertight seal is formed.

The distal end 152 of the upper 136, unlike those shown in previous embodiments, does not also fold over the lining 134 over the last board 132, but instead extends outward. As a result, it is not sandwiched between the midsole 142 and the last board 132 and is not held in place by the cement gasket 146. In this embodiment, the midsole 142 and the outsole 144 are larger than the last board 132 and create a shelf 154 extending beyond the edges 138 of the last board 132. The distal end 152 of the upper 136 is laid flush against the shelf 154 and is stitched to the midsole 142 and the outsole 144 by stitching 158 that is independent of the attachment of the midsole 142 to the lining 134 and the last board 132. Optionally, the midsole 142 and the outsole 144 may be a single unitary body and not separate components.

Thus FIGS. 5 and 6 show the construction of a boot 130 that begins by using the last board 132 is a substrate. The lining 134 and upper 136 are coextensive except to the extent that the lining 134 extends further over the last board 132 than the upper 136. Next, the distal end 140 of the lining 134 is extended over the peripheral region of the last board 132, but does not extend over the medial region 137 of the last board 132. It may then be permanently affixed to a midsole 142 by a gasket of cement 146. The distal end 152 of the upper 136 is extended over and lies flush against the shelf 154 of the midsole 142. Stitching 158 may then be used to affix the distal end 152 of the upper 136 to the midsole 142 and the outer sole 144. All or a portion of the upper 136 and lining 134 may be affixed to each other by adhesive, cement, stitching or the like.

Figure 7:
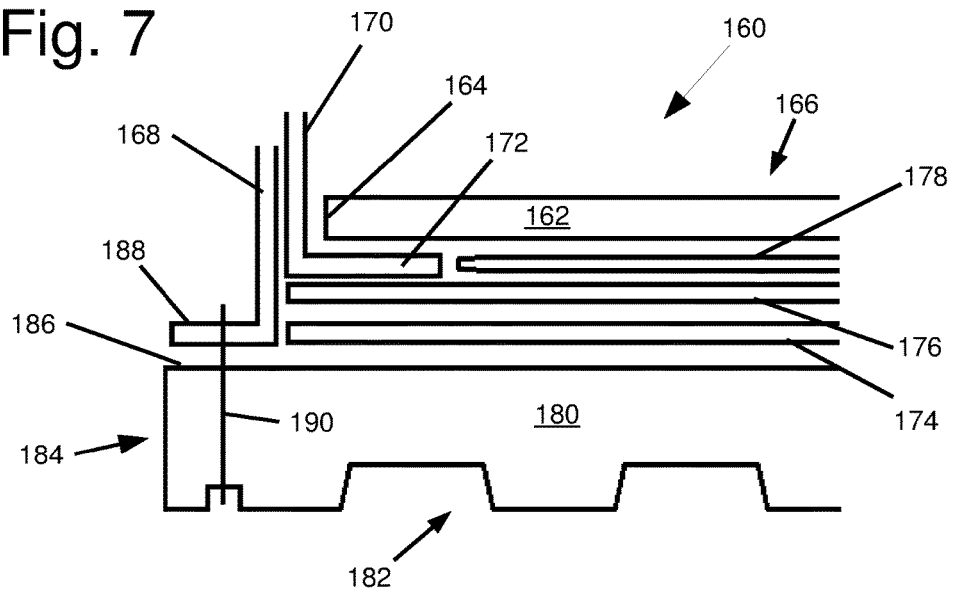
FIG. 7 is a front cross-sectional view of a portion of an alternative embodiment of a footwear item manufactured in accordance with the principles of the invention.

FIG. 7 shows another alternative embodiment of a boot 160 in accordance with principles of the invention. FIG. 7 shows a region similar to that shown in FIG. 6. That is, it shows a cross-section of the layers and components of the boot 160. The Boot 160 is also formed around a last board 162 having a peripheral adage 164 and a medial region 166. An upper 168 and a lining 170 may be configured flush against and coextensive with one another for most of their respective areas. The upper 168 and lining 170 may be so configured where they are pulled over the edges 164 of the last board 162. At that point however, they depart.

The distal end 172 of the lining 170 is then stretched over the periphery of the last board 162 where it is sandwiched between the last board 162 and the midsole 174, which are affixed to one another by gasket 176. In this embodiment, the midsole 174 is coextensive with the last board 162 and has approximately the same area, unlike the midsole shown in FIGS. 5 and 6. Also in this embodiment, stuffing 178 has been inserted between the medial region 166 of the last board 162 and the midsole 174. The stuffing 178 may be comprised of cork or other insulating material and may serve as cushioning, installation or both. Where the lining 170 is particularly thick, such as for example when it is comprised of four layers as shown in FIG. 3 above, the use of stuffing may prevent the last board from the sagging or becoming an even in the medial region 166 as a result of the lining 170 extending only over the peripheral region of the last board 162.

The outsole 180 has treading 182 on its bottom and a peripheral region 184 making it wider than the midsole 174 and thus forms a shelf 186 beyond the portion of the outsole 180 covered by the midsole 174 and the rest of the boot 160. The distal end 180 of the upper 168 extends over and lies flush with the shelf 186 of the outsole 180. The boot 160 shown in FIG. 7 thus has an upper similar to the one shown in FIGS. 5 and 6 which extends outward from the rest of the boot. However, the boot 160 of FIG. 7 has a midsole 174 that is smaller. The boot 160 of FIG. 7 also includes the stuffing 178.

Figure 8:
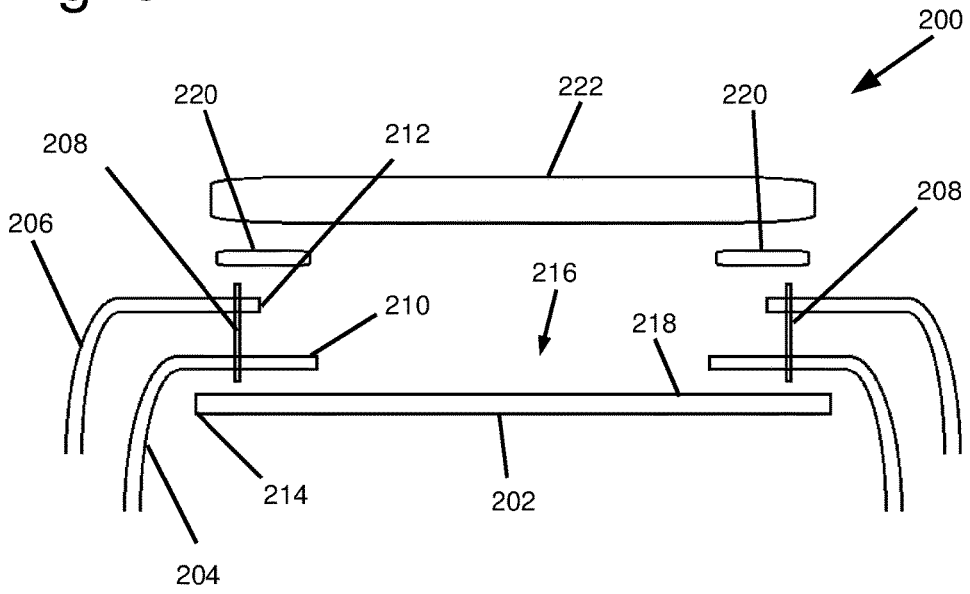
FIG. 8 is a front cross-sectional view of an alternative embodiment of a method of manufacturing footwear in accordance with the principles of the invention.

FIG. 8 shows another embodiment of a boot 200 manufactured using a method in accordance with the principles of the invention. The boot 200 may be formed around a last board 202 that has the approximate shape of the bottom of a person's foot. In this embodiment, the lining 204 and the upper 206 are stitched together by stitching 208. The stitching 208 stretches across the entire length of the upper and lining. The distal end 210 of the lining 204 extends a greater distance than the distal end 212 of the upper 206. When the upper 206 and lining 204 are lasted, that is pulled over the edge 214 of the last board 202, the lining 204 extends a further distance toward the medial region 216 of the last board 202. An adhesive or cement may optionally be applied to the last board 202 before the lining 204 and upper 206 are lasted, thereby affixing the lining 210 to the outer side 218 of the last board 202.

Once the lining 204 and the upper 206 have been lasted and pulled over the edge 214 of the last board 202, a primer 220 may be applied to the outer side of the last board, lining to attend and at least the region of the upper 206 where the stitching 208 is located. The primer 220 may be heat activated, causing it to adhere to the last board 202, lining 204, upper 206 and stitching 208. Once the primer is applied, the gasket 222 may be applied. The gasket 222 may be comprised of a thick layer of cement or may optionally include a mesh or other carrier. Optionally, the gasket 222 may be comprised of a thin fibrous material coated with a adhesive material or cement that remain solid at room temperature. Once the gasket is applied, it may be heat activated. This causes the adhesive to melt, permeate the fibrous material, the openings in the lining 204 and upper 206 created by the stitching 208. A vacuum press may also be used to seal the gasket securely to the bottom of the boot 200. Once the gasket 222 has been affixed to the lining 204 and the last board 202, a continuous watertight barrier is formed surrounding what will be calm the interior of the boot 200. The waterproof seal results from the permanent affixing of the lining 204 to the last board 202 by a gasket 222 that covers the stitching 208 and extends over the outer side of the last board 202. Because the materials used to form the lining 204 are both waterproof and breathable, a boot 200 formed in accordance with the principles of the invention is both watertight and allows the boot 200 to breathe.

Figure 9:
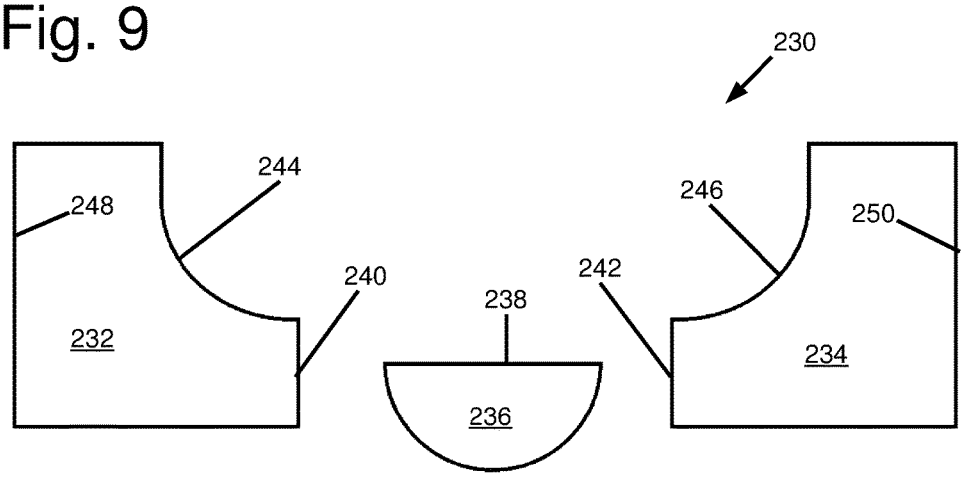
FIG. 9 is a pattern for a lining for use in manufacturing a footwear item in accordance with the principles of the invention.

FIG. 9 shows a pattern for creating a lining in accordance with the principles of the invention. Most methods of forming a lining for an item of footwear involve stitching or using heat tape to combine two flat two-dimensional pieces of material. This is undesirable for use in a three-dimensional shape such as a shoe or boot. This manufacturing only increases the wrinkles found inside a boot in its lining. In accordance with the methods of the present invention, a three-dimensional lining may be created having seams that are stronger and more resistant to wear and therefore have improved waterproof qualities. Lining pattern 230 includes two mirror image sides 232 and 234 as well as a toe region 236. One benefit of this pattern is that it has straight and flat seams that may be easily bonded in a waterproof fashion. The seam 238 on the toe region 236 is configured to be sewn and/or heat taped to seams 240 and 242. The seams 244 and 246 are configured to be sewn and/or heat taped to each other. Also, seams 248 in 250 are configured to be connected to each other.

Figure 10:
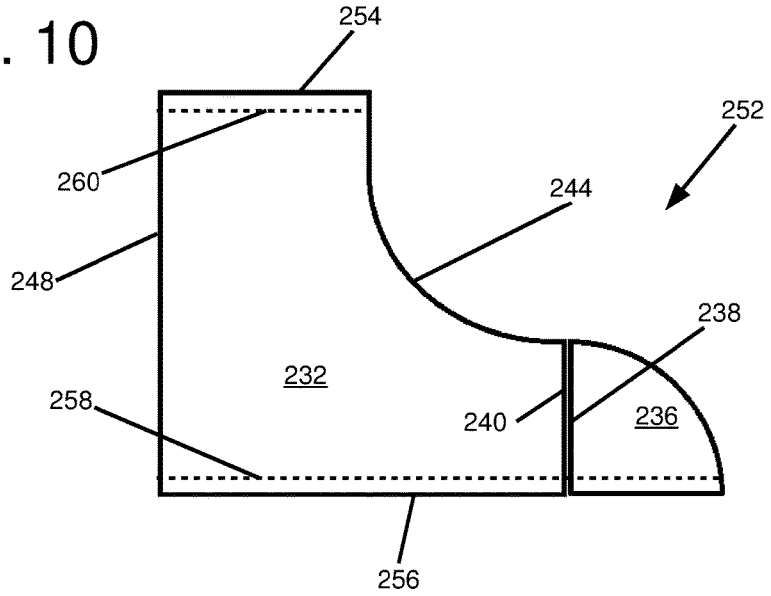
FIG. 10 is a side elevation view of a lining for use in manufacturing a footwear item in accordance with the principles of the invention.

The resulting lining 252 is shown in FIG. 10. This side view shows seams 238 and 240 attached to one another. The seams may be connected by stitching and then applying heat tape to form a waterproof seal. The top region 254 of the lining 252 may be stitched to the top region of an upper along seam 260. Similarly, the lower region of the lining 252 may be sewn two and upper along seam 258. When the lining is lasted over a last board, it's distal end 256 is pulled over the edge of a last board and toward the medial region of the last board. Then the seam 258 is sealed by application of a gasket.

Whereas, the present invention has been described in relation to the drawings attached hereto, it should be understood that other and further modifications, apart from those shown or suggested herein, may be made within the spirit and scope of this invention. Descriptions of the embodiments shown in the drawings should not be construed as limiting or defining the ordinary and plain meanings of the terms of the claims unless such is explicitly indicated.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

The invention claimed is:

1. A method for manufacturing a footwear item, comprising the steps of:

providing a planar last board having a top, a bottom and a peripheral edge having the shape of a bottom of the footwear item;

providing an upper comprising an upper material in a shape of the footwear item except for the bottom of the footwear item and extending from a top end to a bottom distal end, the distal end of the upper being configured to fit around the peripheral edge of the last board;

providing a lining in a shape of the upper and extending from a top end to a bottom distal end, the distal end of the lining being configured to fit over the peripheral edge of the last board;

stitching the top ends of the upper and the lining together to form the top of the footwear item;

pulling the distal end of the lining over the peripheral edge of the last board and partially over the bottom of the last board;

extending the lining over the last board and the upper material, wherein the lining extends over and beyond the upper material;

affixing portions of the upper and the lining that extend over the last board to each other;

pulling the distal end of the upper over the lining and over the peripheral edge of the last board and partially over the bottom of the last board; and attaching an outsole to the last board by applying a gasket over the entire last board and the portions of the lining and upper extending over the last board such that an airtight and waterproof seal is formed between the last board and the lining, the upper and the outsole.

2. The method for manufacturing a footwear item of claim 1 wherein an exposed region of the upper material that extends over the last board is treated to have a rough surface.

3. The method for manufacturing a footwear item of claim 2 wherein the lining comprises a monolithic membrane laminated between the porous membrane and the face fabric.

4. The method for manufacturing a footwear item of claim 2 wherein the lining comprises a face fabric layer, a membrane layer and a tricot abrasive layer laminated together.

5. The method for manufacturing a footwear item of claim 2 further comprising the step of connecting portions of the lining and the upper extending over the last board using stitching.

6. The method for manufacturing a footwear item of claim 1 further comprising the step of connecting portions of the lining and the upper extending over the last board.

7. The method for manufacturing a footwear item of claim 1 wherein the lining is formed from two mirror image sides panels and a toe panel connected at straight seams.

* * * * *